US011495887B2

(12) United States Patent
Mallegol et al.

(10) Patent No.: US 11,495,887 B2
(45) Date of Patent: Nov. 8, 2022

(54) BROADBAND WIRE ANTENNA

(71) Applicant: THALES, Courbevoie (FR)

(72) Inventors: Stéphane Mallegol, Brest (FR); Pierre Belec, Brest (FR); Yoann Henaff, Brest (FR)

(73) Assignee: THALES, Courbevoie (FR)

( * ) Notice: Subject to any disclaimer, the term of this patent is extended or adjusted under 35 U.S.C. 154(b) by 57 days.

(21) Appl. No.: 17/050,970

(22) PCT Filed: May 3, 2019

(86) PCT No.: PCT/EP2019/061399

§ 371 (c)(1),
(2) Date: Oct. 27, 2020

(87) PCT Pub. No.: WO2019/211446

PCT Pub. Date: Nov. 7, 2019

(65) Prior Publication Data

US 2021/0126374 A1 Apr. 29, 2021

(30) Foreign Application Priority Data

May 4, 2018 (FR) ..... 18 00429

(51) Int. Cl.
*H01Q 9/27* (2006.01)
*H01Q 1/38* (2006.01)
(Continued)

(52) U.S. Cl.
CPC ..... *H01Q 9/27* (2013.01); *H01Q 1/36* (2013.01); *H01Q 1/38* (2013.01); *H01Q 11/105* (2013.01);
(Continued)

(58) Field of Classification Search
CPC ..... H01Q 9/27; H01Q 1/38; H01Q 11/105; H01Q 15/14; H01Q 17/00; H01Q 1/36; H01Q 15/006
(Continued)

(56) References Cited

U.S. PATENT DOCUMENTS 7,612,676 B2 * 11/2009 Yuen ..... G06K 19/07749 340/572.1
2009/0174623 A1 * 7/2009 Schreider ..... H01Q 1/36 343/895
(Continued)

FOREIGN PATENT DOCUMENTS

DE 100 34 547 A1 1/2002
FR 2 922 687 A1 4/2009
(Continued)

OTHER PUBLICATIONS

French Search Report, from the French Patent Office in counterpart French Application No. 1800429, dated Jan. 31, 2019.
(Continued)

*Primary Examiner* — Hai V Tran
(74) *Attorney, Agent, or Firm* — ArentFox Schiff LLP

(57) ABSTRACT

The invention relates to a wire antenna suitable for operating in at least one frequency band, including a plurality of stacked layers, including at least one radiating element placed on a support layer, said support layer being placed on a spacing substrate placed on a reflective plane, characterised in that it includes at least one resistive grille having a resistive surface with predetermined resistance, including at least one set of repetitive, non-contiguous empty patterns, said grille being placed between the spacing substrate and the reflective plane.

9 Claims, 4 Drawing Sheets

(51) Int. Cl.

| | |
|---|---|
| ***H01Q 15/14*** | (2006.01) |
| ***H01Q 17/00*** | (2006.01) |
| ***H01Q 11/10*** | (2006.01) |
| ***H01Q 1/36*** | (2006.01) |
| ***H01Q 15/00*** | (2006.01) |

(52) U.S. Cl.
CPC ..... *H01Q 15/006* (2013.01); *H01Q 15/14* (2013.01); *H01Q 17/00* (2013.01)

(58) Field of Classification Search
USPC ..... 343/895
See application file for complete search history.

(56) References Cited

U.S. PATENT DOCUMENTS

| | | | | |
|---|---|---|---|---|
| 2014/0043197 | A1* | 2/2014 | Lee | H01Q 9/30 29/600 |
| 2019/0214731 | A1* | 7/2019 | Christie | H01Q 15/14 |

FOREIGN PATENT DOCUMENTS

| | | | |
|---|---|---|---|
| FR | 2 965 669 | A1 | 4/2012 |
| FR | 3 017 493 | A1 | 8/2015 |
| FR | 3 052 600 | A1 | 12/2017 |
| WO | WO 2018/041809 | A1 | 3/2018 |

OTHER PUBLICATIONS

International Search Report, issued by International Searching Authority in corresponding International Application No. PCT/EP2019/061399, dated Jul. 3, 2019.

* cited by examiner

BROADBAND WIRE ANTENNA

CROSS-REFERENCE TO RELATED APPLICATIONS

This application is a National Stage Entry of International Patent Application No. PCT/EP2019/061399, filed on May 3, 2019, which claims priority to French Application No. 18 00429, filed on May 4, 2018. The disclosures of the priority applications are incorporated in their entirety herein by reference.

FIELD OF THE INVENTION

The present invention relates to a wire antenna capable of operating in at least one predetermined frequency band, comprising a plurality of superimposed layers.

The invention finds applications, in particular, in the field of electromagnetic monitoring systems.

BACKGROUND OF THE INVENTION

In an electromagnetic monitoring system, for example airborne or naval, the antennas, which are used either individually or in a goniometric array, must operate in a very wide frequency band and in a circular, linear or double linear polarization, corresponding to the ranges of interest of respective electromagnetic signals in frequency and polarization.

These antennas must have the smallest possible size and, in particular, a low thickness, in particular to be more easily integrated on carriers. They must also exhibit radiation performance (gain, quality of radiation patterns, etc.) that is reproducible from one antenna to another, in particular for network applications, or to allow replacement during a maintenance operation.

In this context, it is known to use wire antennas. In such an antenna, the radiating element consists of a metal wire which is shaped to describe, in a so-called radiation surface, a pattern of the spiral type or of the log-periodic type.

In an antenna of the spiral type, the metal wire is wound on itself so as to form, in top view, a spiral. This spiral may, for example, be an Archimedean spiral, a logarithmic spiral, or another type.

In an antenna of the log-periodic type, the metal wire is shaped so as to include, in top view, several strands. Each strand is inscribed in an angular sector, extends radially and has indentations. The length of each tooth and the spacing between two successive teeth of one strand follow a logarithmic progression.

In practice, in planar technology, the metal wire as the radiating element is produced by etching a thin metal layer, for example a layer of copper with a thickness of between 2 and 20 μm (micrometers), deposited on a thin and insulating support (dielectric) layer.

In the prior art, first wire antennas with an absorbing cavity are known, in which the radiating element, etched on a flat or shaped radiating surface, is located above an absorbing cavity delimited by metal walls, and filled with a material absorbing electromagnetic waves. The radiating element is able to emit a wave which propagates towards the front of the radiating surface (away from the absorbing cavity) and a wave which propagates towards the rear of the radiating surface (towards the absorbent cavity). The latter is absorbed by the absorbent cavity.

Such an antenna is very bulky because of the dimensions of the absorbent cavity. It also has low efficiency since half of the power emitted by the radiating element is absorbed in the absorbent cavity. Finally, the reproducibility of the radio performance of such an antenna is difficult to obtain, due to a lack of control over the electromagnetic characteristics of the absorbent material filling the cavity.

In a second wire antenna according to the prior art, the radiating elements are placed on a charged electromagnetic structure with a forbidden band, called LEBG (for Loaded Electromagnetic Band Gap), on a lower ground plane. In such an antenna, a surface composed of periodic metal patterns connected by resistors is placed in the cavity of the antenna. In this antenna, the wave emitted backwards by the radiating element is absorbed in a thin layer consisting of a metallic reflective plane topped with metal and the LEBG material charged by resistors.

This solution makes it possible to obtain broadband antennas of low thickness, and having improved radiation stability. However, due to the absorption of surface waves, the radiation performance is similar to that of absorbent cavity antennas.

In a third wire antenna of the prior art, the radiating element is etched on a high impedance surface (HIS), resting on spaced periodic metal patterns, placed in the cavity of the antenna and connected to the ground plane by metallized bonds, also called vias. The efficiency band of such an antenna in which the interference between the incident wave and the reflected wave is constructive corresponds approximately to one octave. Therefore, this type of antenna is limited to narrow bands of operation, and does not allow simultaneous coverage of a multi-octave frequency band.

In a fourth wire antenna of the prior art, described in patent application FR3017493, it has been proposed to insert, between the radiating element with a wide frequency band and the spacing substrate layer, one or more layers with sets of periodic resistive patterns, either with a single set of resistive patterns, or several sets of nested resistive patterns. In patent application FR3052600, such a layer comprises resistive patterns having resistance values varying progressively between a central antenna point and an outer edge of the antenna. The resistive patterns are placed in the near field of the radiating element of the antenna. The antennas obtained are compact and allow a large gain to be obtained over a wide frequency band, without significant ripple of the radiation patterns.

However, these antennas exhibit surface waves (or creeping waves) that propagate through the lower ground plane of the antenna cavity, and beyond onto the metal support on which the antenna is mounted. These surface waves, associated with structural edge effects, combine with the main electric field radiated by the antenna and result in a degradation of the quality of the radiation pattern. In fact, wave effects, all the more important as the frequency is high, appear in the main lobe of the radiation pattern. Thus, the antenna gain is degraded, as well as the half-power angular aperture for the main beam lobe.

When the antennas are used in a direction finder array, there is a degradation in the accuracy of determining the angle of arrival and an increase in mutual coupling between antennas.

The aim of the invention is to correct the aforementioned problems, by providing a wire antenna that is compact and capable of operating in a wide frequency band for which the effects of surface waves are controlled in order to eliminate the defects mentioned above.

SUMMARY OF THE INVENTION

To this end, the invention provides a wire antenna designed to operate in at least one frequency band, comprising a plurality of superimposed layers, comprising at least one radiating element placed on a support layer, said support layer being placed on a spacing substrate placed on a reflective plane. This antenna comprises at least one resistive grille with a resistive surface of predetermined resistance, comprising at least one set of repetitive non-contiguous empty patterns, said resistive grille being placed between the spacing substrate and the reflective plane.

Advantageously, the wire antenna according to the invention, thanks to the presence of a resistive grille with empty patterns which makes it possible to trap and/or attenuate the surface waves, exhibits an increased gain.

Advantageously, the wire antenna according to the invention may have one or more of the characteristics below, taken independently or in combination, in any technically acceptable combination.

The antenna has a resistive peripheral zone surrounding the set or sets of empty patterns.

All the empty patterns of at least one set of said grille have the same geometric shape and are regularly spaced.

The antenna comprises a central axis orthogonal to the superimposed layers, said resistive grille comprising at least two concentric sets of empty patterns, each set comprising empty patterns of square shape and of the same size, the size of the empty patterns being different between two different concentric sets, the size of the empty patterns of a said set increasing as a function of the distance of said set from said central axis of the antenna.

Each set of square empty patterns of the same size corresponds to a sub-band of operating frequencies of the antenna having an associated center frequency and an associated wavelength, while the patterns are square with a side less than or equal to said wavelength.

The resistive grille forms a first resistive layer, the antenna further comprising a second resistive layer placed between the support layer of the radiating element and the spacing substrate, said second resistive layer comprising at least one set of resistive patterns of the same resistive value occupying a partial zone of said second resistive layer, while the or each set of empty patterns of the first resistive layer is placed opposite a zone devoid of resistive patterns of said second resistive layer.

The antenna comprises a first resistive grille comprising a first set of empty patterns interposed between a first spacing substrate and a second spacing substrate, and a second resistive grille, comprising at least a second set of empty patterns, interposed between the second spacing substrate and the reflective plane, the first set of empty patterns being placed facing a resistance-free zone of the second resistive grille, the second set of empty patterns being placed facing a resistance-free zone of the first resistive grille.

The or each resistive grille comprises a resistive surface produced by depositing a resistive ink in which said empty patterns are formed by a recess.

The or each resistive grille is produced by screen printing or by 3D printing.

The radiating element is wired, wound in a spiral winding, log-periodic or sinuous.

BRIEF DESCRIPTION OF THE DRAWINGS

Other characteristics and advantages of the invention will become apparent from the description given below, by way of indication and in no way limiting, with reference to the appended figures, among which.

DETAILED DESCRIPTION OF EMBODIMENTS

Figure 1:
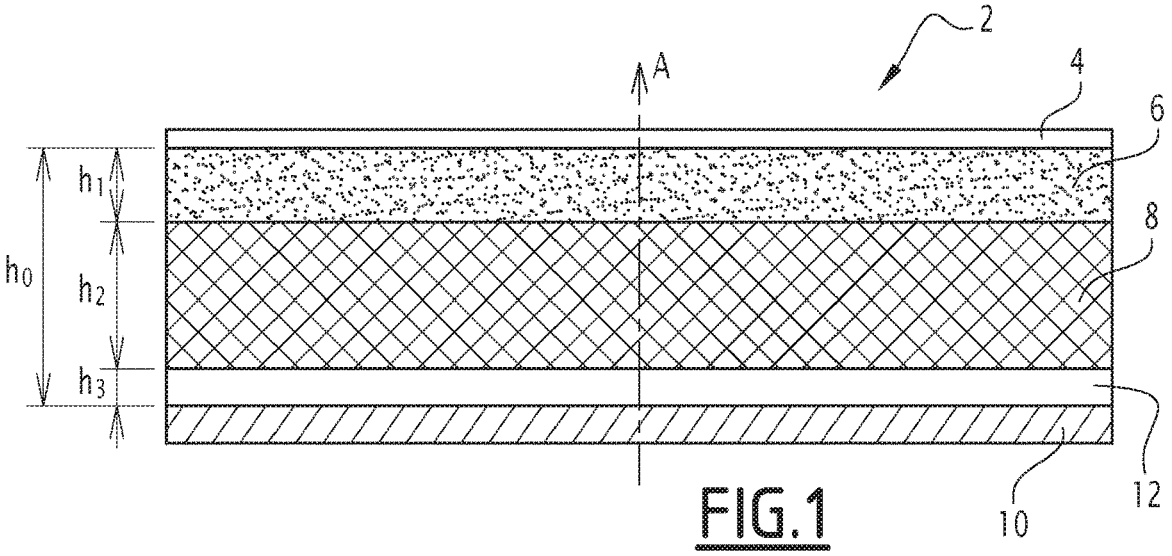
FIG. 1 is a cross-sectional view of a wire antenna according to a first embodiment of the invention.
Figure 2:
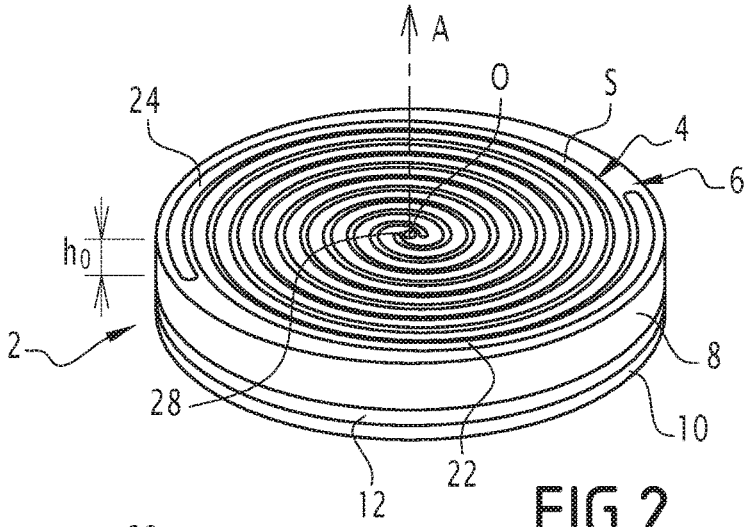
FIG. 2 is a perspective representation of a wire antenna according to the first embodiment.
Figure 3:
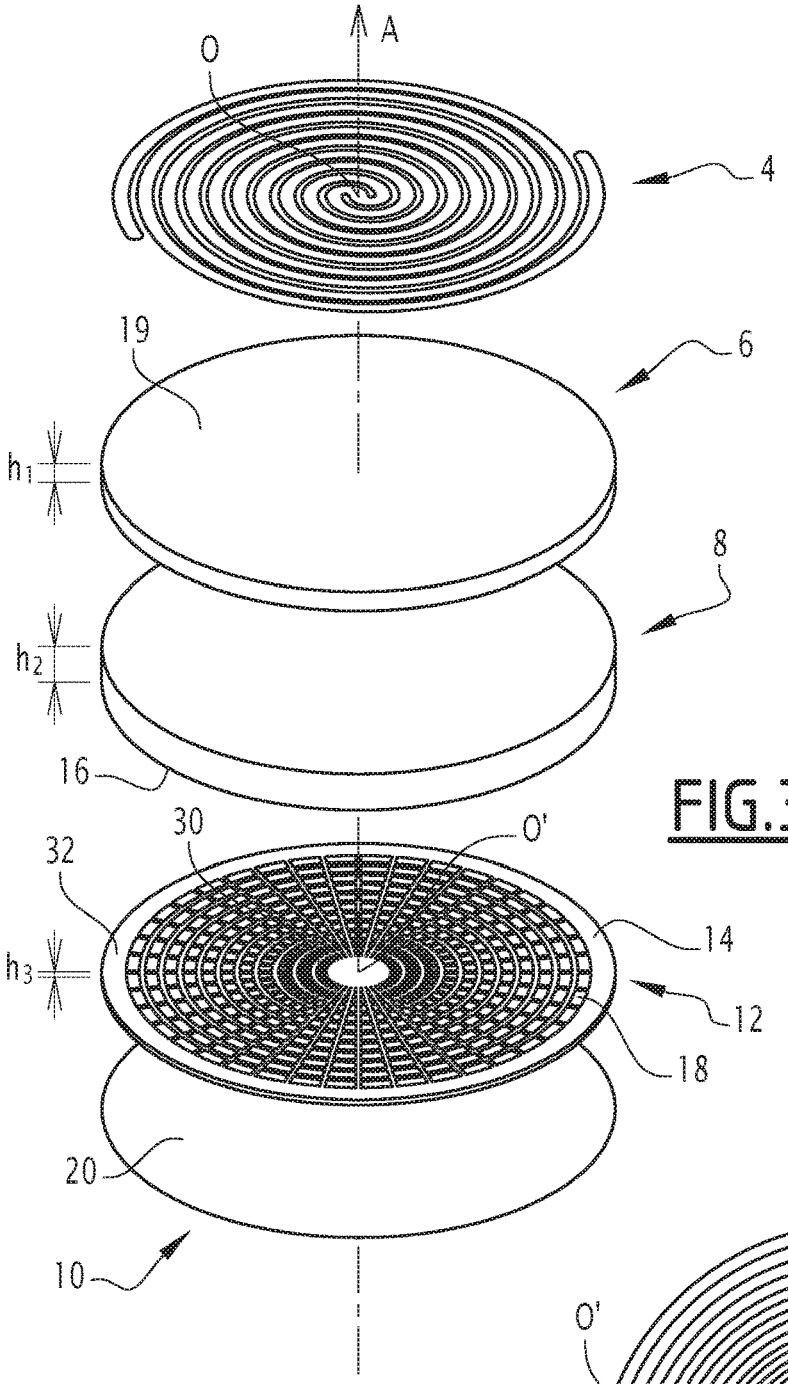
FIG. 3 is an exploded perspective representation of a wire antenna according to the first embodiment.

FIGS. 1 to 3 schematically show a wire antenna 2 according to a first embodiment of the invention, in cross-section, in perspective view and in exploded perspective view.

In this embodiment, the wire antenna 2 is a wide frequency band antenna, for example, capable of operating in a frequency range of 1 GHz (GigaHertz) to 20 GHz.

In this embodiment, the wire antenna 2 has the shape of a disc of circular circumference with center O, and is composed of several concentric layers stacked in thickness along an axis A. The axis A is a central axis orthogonal to the axis of the antenna radiation plane.

By way of non-limiting numerical example, the antenna 2 has an outer diameter of 45 mm.

Alternatively, the antenna may have another regular geometric shape, for example elliptical or rectangular, also having a central axis of similar symmetry.

A radiating element 4, arranged in a flat surface S, also called a radiating surface, is positioned on a planar support layer 6, itself placed above a spacing substrate 8.

The support layer 6 may be formed, for example, by a first dielectric substrate, for example of a ceramic type reinforced with glass fibers, having a first thickness h1, for example between 0.128 mm and 1.524 mm, for example equal to 0.254 mm.

Of course, these dimensions are given here by way of example only, and other thickness may be calculated, depending on the permittivity of the materials, for operation in a given frequency band.

The spacing substrate 8 is placed above a reflective plane or ground plane 10.

The reflective plane 10 is preferably metallic, and is located at a distance h0 below the radiating surface S. Its function is to reflect any incident wave whatever its frequency within a given frequency interval.

The spacing substrate 8 has the general outer shape of an A-axis disc with a second substantially constant thickness h2. This spacing substrate is a second dielectric substrate of given relative permittivity. For example, it may be made of a dielectric material of low relative permittivity (e.g. uncharged foam) or a dielectric material of the Duroid type (registered trademark) or a possibly multilayer composite material.

In one embodiment that is suitable, in particular, for the operation of the antenna in the frequency bands L to Ku, the second thickness h2 of the spacing substrate 8 is greater than the first thickness h1 of the support layer 6. For example, the thickness of the spacing substrate 8 is between 4 mm and 8 mm, for example equal to 6 mm.

Of course, these dimensions are given here by way of example only, in the case of an application making it possible to generate constructive interference between the radiating element 4 and the reflective plane 10 in L and Ku bands, taking into account the materials chosen and the first thickness h1.

Alternatively, the spacing substrate 8 may be made of a pure magneto-dielectric or magnetic material.

In an alternative embodiment, the spacing substrate 8 is formed from a progressive or pierced dielectric material, hollowed out at its center, so as to achieve an increasing relative permittivity from the center to the outer edge.

Between the reflective plane 10 and the spacing substrate 8 is arranged a resistive grille 12, comprising a resistive surface 14 with a predetermined resistivity value and at least one set of non-contiguous repetitive recesses (or holes) 18 so as to form said grille. The recesses 18 are zones devoid of resistivity, hereinafter called empty patterns.

In one embodiment, the recesses 18 are produced by the absence of a deposit of resistive material.

The resistive grille 12 is, according to a first variant embodiment, arranged on one face 16 of the spacing substrate 8, or lower face, oriented towards the reflective plane 10.

According to a second embodiment variant, the resistive grille 12 is arranged on one face 20 of the reflective plane 10, called the upper face and oriented towards the radiating element 4.

According to a third variant (not shown), the resistive grille is placed on a third dielectric, magnetic or magneto-dielectric substrate interposed between the face 6 of the spacer 8 and the face 20 of the reflective plane 10.

Thus, the resistive grille 12 is placed in a zone called the bottom of the cavity, between the spacing substrate 8 and the reflective plane 10.

Preferably, the resistive grille 12 is made from a resistive film, while the empty patterns 18 are, for example, made by recessing the resistive film. Alternatively, the resistive grille may be produced by depositing a resistive ink according to a pattern, so as to form the desired empty patterns by absence of the deposit of resistive ink.

For example, the resistive grille 12 may be produced by conventional screen printing process or any other equivalent process, for example 3D printing or aerosol printing.

The resistive grille 12 has a third thickness h3, which may vary between a few micrometers and a few tens of micrometers depending on the desired resistance value and depending on the intrinsic characteristics of the resistive ink used.

The radiating element 4 comprises in this first embodiment, first and second metal wires 22 and 24 which are respectively shaped in a pattern of the spiral type or of the sinuous log-periodic type, for example. More specifically, the pattern forms an Archimedean spiral in the first embodiment, as illustrated in FIGS. 1 to 3.

Each wire, 22, 24, is wound around the origin point O, which corresponds to the intersection of the axis A and the radiating surface S.

The radiating element 4 may be produced, for example, by an etching operation, directly on the upper face 19 of the support layer 6.

Alternatively, the radiating element may be a single polarization or dual polarization element of the DuHamel sinuous type.

According to another variant, the radiating element may be hybrid.

A power supply device (not shown) for the radiating element 4 is positioned below the reflective plane 10, which is electrically connected to ground. The reflective plane 10 and the layers 12, 8, 6 positioned above are pierced with a recessed passage 28, along the axis A, for the passage of conductive wire(s) making it possible to supply electric power to the radiating element 4.

In operation, an active zone of the radiating element 4 emits a first direct wave propagating towards the front, i.e. away from the spacing substrate 8, and a second wave propagating towards the rear, i.e. in the direction of the spacing substrate 8.

The second wave passes through the spacing substrate 8 and the resistive grille 12, and is reflected by the reflective plane 10 to then again pass through the resistive grille 12 and the spacing substrate 8.

The resistive grille 12 comprises regular empty patterns 18 arranged in this embodiment on concentric rings with the center O', and a non-resistive central zone 30, comprising the recessed passage 28.

The resistive layer 12 comprises a peripheral zone 32, annular in this first embodiment, which does not include empty patterns, in other words it is a solid resistive zone for better absorption efficiency of surface waves in this zone.

The peripheral zone is located near the outer edge of the antenna, for example between the outer edge of the antenna and the resistive grille.

In the embodiment illustrated in FIG. 3, the empty patterns 18 are distributed over concentric rings to form, by ring, sets of empty patterns of the same size and geometric shape, distributed regularly on the ring. In addition, on all of the rings, the empty patterns are aligned radially and corresponding to the same angular width.

Figure 4:
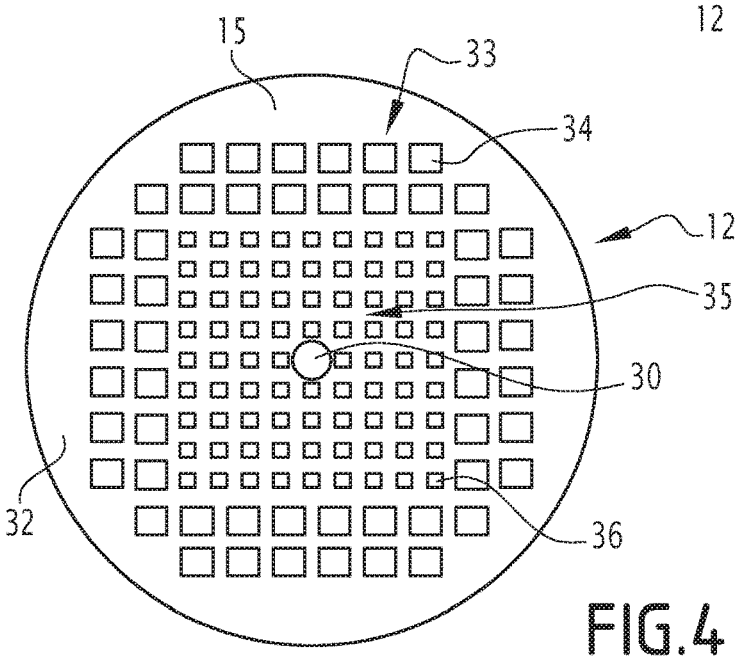
FIG. 4 is a top view of a resistive grille according to a first variant embodiment.

According to a variant of this first embodiment, the resistive grille 12 comprises empty patterns 34, 36 of square shape as illustrated in FIG. 4.

According to this variant, the resistive grille 12 comprises a resistive surface 15, and two sets of empty patterns, a first set 33 of first square-shaped patterns 34 and a second set 35 of second square-shaped patterns 36. In each set, the patterns are arranged according to an orthogonal design, with regular spacing between two successive patterns.

For example, the resistive surface has a resistivity of 1000Ω per square.

The first set 33 of empty patterns forms a first external zone, close to the external edge of the grille 12, while the second set 35 of empty patterns forms a second internal zone of square shape.

At the center of the grille is located the circular zone 30, which, in one embodiment corresponds to the recessed passage 28. According to a variant, the circular zone 30 has a diameter greater than the diameter of the central recessed passage 28. The circular zone 30 corresponds. to a recessed surface (non-resistive).

The first square patterns 34 have an area greater than the area of the second square patterns 36. For example, the first patterns 34 are 6.4 mm square, and are positioned in an active zone for the antenna ranging, approximately, from 2 GHz to 4 GHz, while the second patterns 36 are 3.2 mm square and are positioned in an active zone for the antenna ranging, approximately, from 4 GHz to 18 GHz.

More generally, preferably, for each set of empty patterns of the same geometric shape, corresponding to a sub-band of operating frequencies of the antenna, the empty patterns are periodized and are of dimensions (sides of the squares) less than the wavelength associated with the central frequency of the sub-band in question radiated by the antenna.

Advantageously, in this embodiment, the radio performance of the antenna is improved in a frequency range from 2 GHz to 18 GHz. In particular, the main lobe of the antenna pattern is formed over the entire frequency band in question. The undulations of the diagrams are not present in vertical polarization and are not very important in horizontal polarization.

Figure 5:
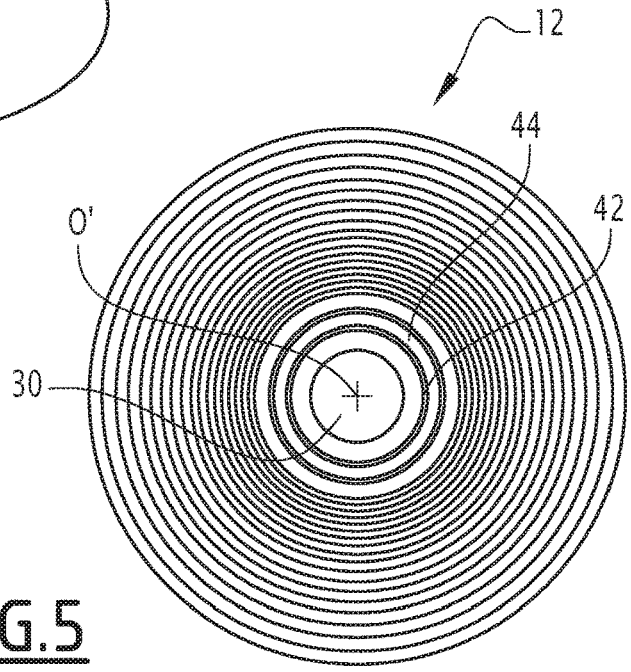
FIG. 5 is a top view of a resistive grille according to a second variant embodiment.

According to another variant illustrated schematically in FIG. 5, the resistive grille 12 may comprise annular empty patterns 42 interposed between resistive rings 44. This is a concentric ring topology, the annular empty patterns 42 being in regular alternation with resistive rings 44. This embodiment is particularly suitable for a spiral radiating element.

Preferably, the heights h1 and h2 of the constituent materials of the antenna are chosen so as to have constructive interference between the radiating element of the spiral type and the reflective plane (lower ground plane of the antenna) in the frequency band of interest.

The shape, size and spatial repetition arrangement or topology of the empty patterns are variable and defined, for each embodiment using 3D electromagnetic simulation software or electromagnetic simulator. In fact, an analytical pre-dimensioning of the resistive patterns is particularly complex.

In general, given a frequency interval to be covered and/or a desired antenna gain, we choose a resistivity value of the resistive grille, a geometric shape per empty pattern and a repetitive topology of the patterns, while the size of the patterns and the spacing of the patterns are calculated using 3D electromagnetic simulation software.

Such simulation software is known, for example software which performs the resolution of Maxwell's equations in integral form, by the finite integral method.

The size and topology of the void patterns are selected to improve the stability of the radiation pattern and promote the absence of ripple, resulting in efficient trapping of surface waves.

For example, these choices are made by carrying out several simulations and comparing the results so as to select the size, shape and spacing of the empty patterns best suited for a targeted application.

Figure 6:
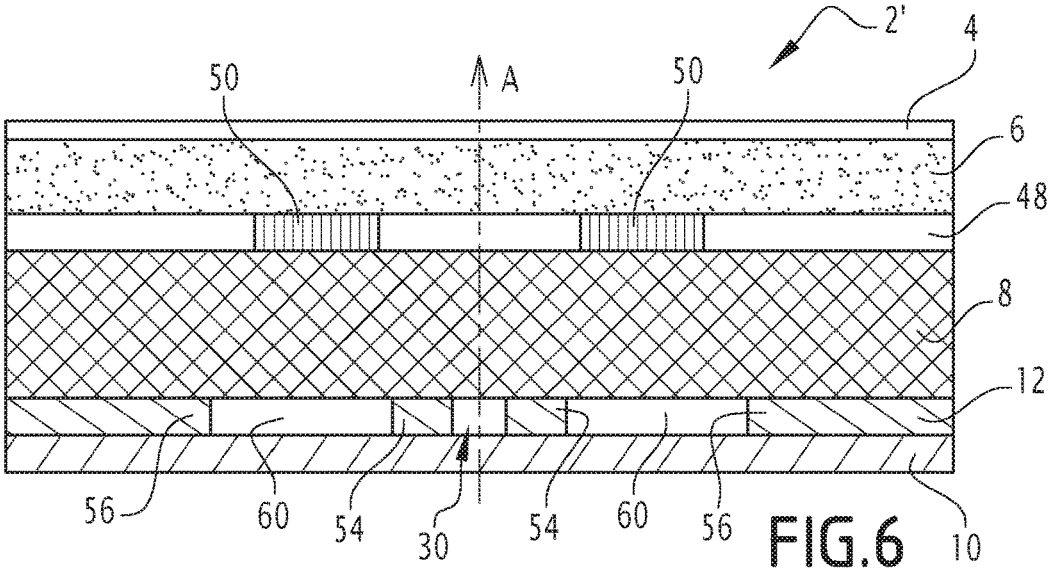
FIG. 6 is a cross-sectional view of a wire antenna according to a second embodiment of the invention.
Figure 7:
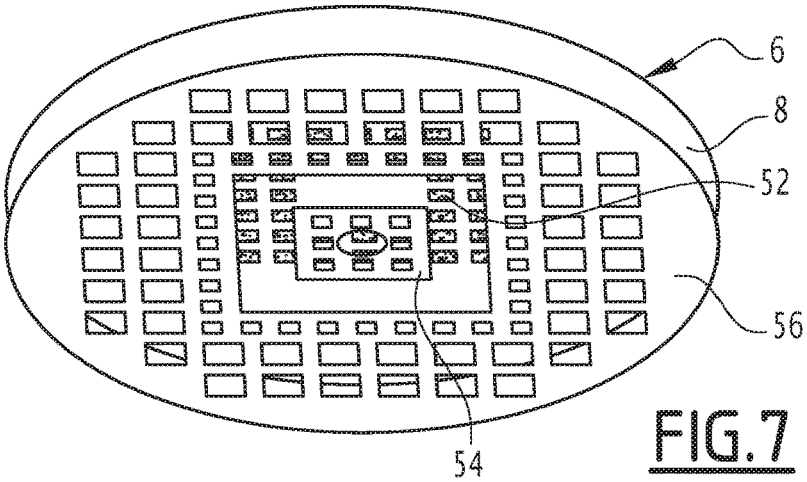
FIG. 7 is a perspective representation of a wire antenna according to the second embodiment.
Figure 8:
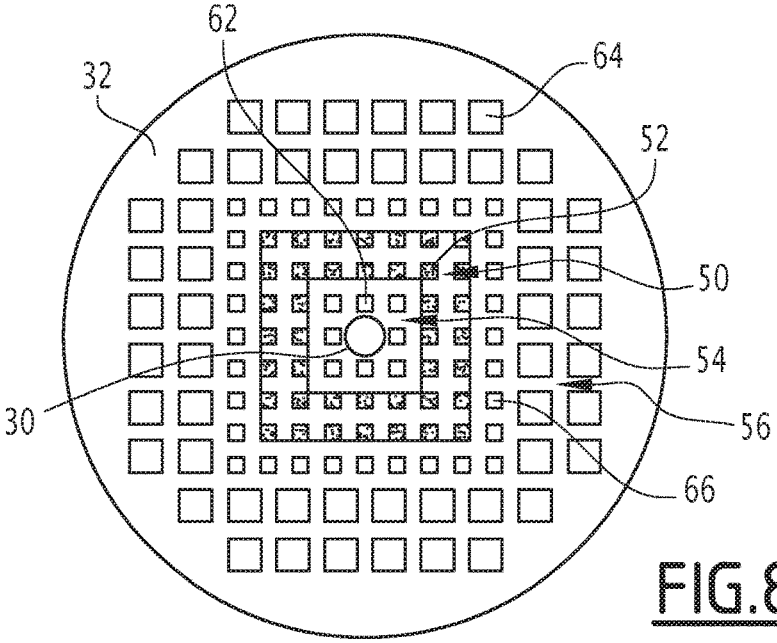
FIG. 8 is a schematic top view of the wire antenna of FIG. 7.

FIGS. 6 to 8 schematically illustrate a wire antenna 2' according to a second embodiment of the invention.

In this second embodiment, the antenna 2' further comprises a second resistive layer 48, between the support 6 and the spacing substrate 8, comprising a set 50 of resistive patterns 52, each resistive pattern 52 having a given resistive resistance surface. Each resistive pattern is produced, for example, by depositing a resistive ink, while the spaces between resistive patterns are empty.

In this embodiment, the first resistive grille 12 comprises two partial resistive sub-grilles 54, 56, each formed by a resistive surface comprising recesses which form empty patterns 62, 64 and 66.

Advantageously, as illustrated in FIGS. 6 to 8, the set 50 of the second resistive layer 48 is placed above a separation zone 60 between the first resistive sub-grille 54 and the second resistive sub-grille 56, this separation zone 60 being an empty zone, without a resistive layer, above the reflective plane 10.

In other words, the set 50 of resistive patterns 52 is placed opposite, i.e. to the right above the non-resistive separation zone 60, so as to be in electromagnetic interaction with the reflective plane. Likewise, each resistive sub-grille 54, 56 comprises at least one set of empty patterns placed opposite a zone devoid of resistive patterns 52 of the resistive layer 48, therefore an "empty" zone without resistance.

As illustrated schematically in FIG. 8, in top view, the set 50 of resistive patterns of the resistive layer 48 forms a spatially nested zone between the first sub-grille 54 and the second sub-grille 56. There is no spatial superposition, in top view, between the zone formed by the set 50 and the first sub-grille 54 and the second sub-grille 56.

In the example shown, the first sub-grille 54 has square empty patterns 62 aligned in a square crown. The first sub-grille 54 has a zone 30 centered on the A axis, without resistance, as in the first embodiment.

In the embodiment shown, the resistive patterns 52 of the resistive layer 48 are of square shape of the same size as the empty patterns 62 of the first sub-grille 54.

The second sub-grille 56 comprises a resistive peripheral zone 32 without a recess, and two sets of empty square patterns 64 and 66 of different sizes.

For example, each resistive sub-grille has a resistivity of 1000Ω per square. The two resistive sub-grilles 54, 56 respectively cover the frequency bands from 2 GHz to 4 GHz, and from 10 GHz to 18 GHz. The set 50 of resistive patterns 52 placed between the spacing substrate 8 and the support 6 covers the frequency band from 4 GHz to 10 GHz.

The antenna defined according to this second embodiment, called a hybrid cavity antenna, promotes an absence of ripple of the radiation patterns over the entire frequency band considered.

Variants of this embodiment are possible, for example by adding a resistance gradient or a multilayer structure of the resistive grille 12.

For example, it is conceivable to produce a resistive grille having a progressive variation in resistance and decreasing between a high resistance value at the periphery and a lower value at its center.

Figure 9:
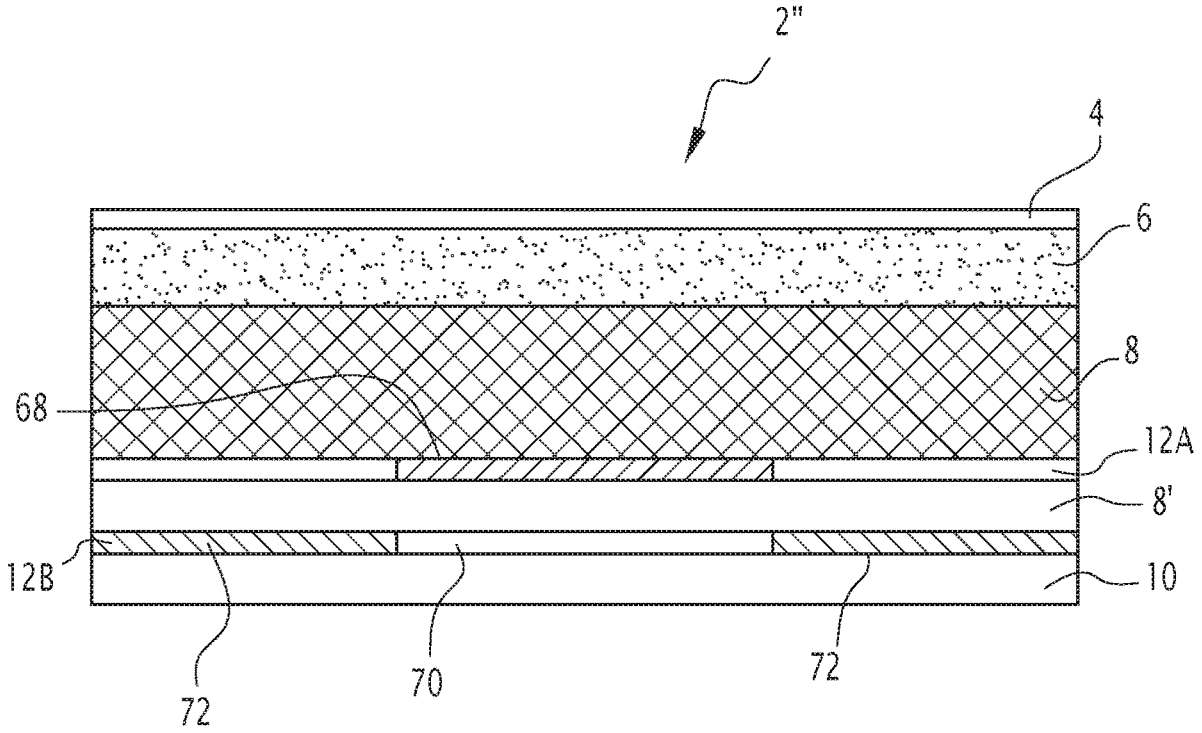
FIG. 9 is a cross-sectional view of a wire antenna according to a third embodiment of the invention.

FIG. 9 schematically illustrates, in cross-section, a multilayer structure of a resistive grille according to a third embodiment of a wire antenna according to the invention.

The antenna 2" of FIG. 9 comprises a radiating element 4 placed on a planar support 6, itself placed on a first spacing substrate 8.

Between the first spacing substrate 8 and the reflective plane 10 are stacked a first resistive grille 12A, a second spacing substrate 8' and a second resistive grille 12B.

The first resistive grille 12A comprises a set 68 of empty patterns, for example a central ring, placed opposite a zone 70 without resistance (empty zone) of the second resistive grille 12B. The second resistive grille 12B comprises a set 72 of empty patterns, arranged for example in a peripheral ring, facing a zone without resistance (empty zone) of the first grille 12A.

According to another embodiment not shown, the antenna may comprise a resistive grille between the reflective plane 10 and the spacing substrate 8 or 8', but the resistive grille does not have a solid resistive peripheral zone.

For all the embodiments envisaged, the resistive grille(s) is/are produced by a conventional screen printing process or any other equivalent process, for example 3D printing or aerosol printing.

The or each resistive grille is deposited either directly on the reflective plane 10, or on the lower face 16 of the spacing substrate 8, or on a dielectric, magnetic or magneto-dielectric substrate placed on the reflective plane 10.

The invention claimed is:

1. Wire antenna designed to operate in at least one frequency band, comprising a plurality of superimposed layers, comprising at least one radiating element placed on a support layer the support layer being placed on a spacing substrate placed on a reflective plane, the antenna comprising at least one resistive grille of resistive surface of predetermined resistance, comprising at least one set of repetitive non-contiguous empty patterns, the resistive grille being placed between the spacing substrate and the reflective plane, further comprising a first resistive grille comprising a first set of empty patterns, the first grille being interposed between a first spacing substrate and a second spacing substrate, and a second resistive grille, comprising at least a second set of empty patterns, the second grille being interposed between the second spacing substrate and the reflective plane, the first set of empty patterns being placed opposite a resistance-free zone of the second resistive grille the second set of empty patterns being placed opposite a resistance-free zone of the first resistive grille.

2. Antenna according to claim 1, comprising a resistive peripheral zone surrounding the at least one set of repetitive non-contiguous empty patterns.

3. Antenna according to claim 1, in which each set of repetitive non-contiguous empty patterns comprises regularly spaced empty patterns having a same geometric shape.

4. Antenna according to claim 3, the antenna comprising a central axis orthogonal to the superimposed layers, the resistive grille comprising at least two concentric sets of empty patterns, each set comprising empty patterns of square shape and of a same size, the size of the empty patterns being different between two different concentric sets, the size of the empty patterns of a set increasing according to a distance of said set from the central axis of the antenna.

5. Antenna according to claim 4, in which each set of square empty patterns of the same size corresponds to a sub-band of operating frequencies of the antenna having an associated center frequency and an associated wavelength, and wherein said patterns are square with a side less than or equal to the wavelength.

6. Antenna according to claim 1, wherein the resistive grille forms a first resistive layer, the antenna further comprising a second resistive layer placed between the support layer of the radiating element and the spacing substrate, the second resistive layer comprising at least one set of resistive patterns of a same resistance value occupying a partial zone of the second layer resistive, and in which the at least one set of repetitive non-contiguous empty patterns, or each set of empty patterns of the first resistive layer is placed opposite a zone devoid of resistive patterns of the second resistive layer.

7. Antenna according to claim 1, in which the or each resistive grille comprises a resistive surface produced by depositing a resistive ink in which the empty patterns are formed by a recess.

8. Antenna according to claim 7, wherein the or each resistive grille is produced by screen printing or by 3D printing.

9. Antenna according to claim 1, wherein the radiating element is wire, wound in a spiral, log-periodic or sinuous winding.

* * * * *